US005160093A

United States Patent [19]

Battaglia

[11] Patent Number: 5,160,093

[45] Date of Patent: Nov. 3, 1992

[54] MULTI-MODE WATERING APPARATUS

[76] Inventor: John J. Battaglia, 5205 Valle Vista NW., Albuquerque, N. Mex. 87120

[21] Appl. No.: 693,387

[22] Filed: Apr. 30, 1991

[51] Int. Cl.[5] ..... B05B 15/06; B05B 9/03

[52] U.S. Cl. ..... 239/444; 239/436; 239/525; 239/276

[58] Field of Search ..... 239/436, 443, 444, 446, 239/447, 276, 525

[56] References Cited

U.S. PATENT DOCUMENTS

| | | | |
|---|---|---|---|
| 192,880 | 7/1877 | Ryon | 239/446 |
| 523,941 | 7/1894 | North et al. . | |
| 581,876 | 5/1897 | Aulls | 239/446 |
| 623,057 | 4/1899 | Wentz . | |
| 1,026,742 | 5/1912 | French . | |
| 1,031,176 | 7/1912 | Gilpin . | |
| 1,081,688 | 12/1913 | Mohl | 239/443 |
| 1,084,843 | 1/1914 | Byler | 239/444 |
| 1,168,219 | 1/1916 | Miller | 239/436 |
| 1,566,232 | 12/1925 | Schreiter | 239/276 |
| 1,612,326 | 12/1926 | Taylor . | |
| 1,830,833 | 11/1931 | Green | 239/276 |
| 2,043,714 | 6/1936 | Schellin | 239/447 |
| 2,364,848 | 12/1944 | Hurst | 239/444 |
| 2,903,190 | 9/1959 | LeDeit | 239/276 |
| 4,903,897 | 2/1990 | Hayes | 239/525 |

FOREIGN PATENT DOCUMENTS

| | | | |
|---|---|---|---|
| 308843 | 6/1933 | Italy | 239/446 |
| 10311 | of 1887 | United Kingdom | 239/446 |
| 525688 | 9/1940 | United Kingdom | 239/444 |

*Primary Examiner*—Andres Kashnikow
*Assistant Examiner*—Christopher G. Trainor
*Attorney, Agent, or Firm*—Deborah A. Peacock; Donovan F. Duggan

[57] ABSTRACT

A combination watering apparatus is disclosed having a plurality of waterways and spray heads. The device may be hand-held or ground mounted, and provides up to four modes of operation.

6 Claims, 4 Drawing Sheets

MULTI-MODE WATERING APPARATUS

BACKGROUND OF THE INVENTION

1. Field of the Invention (Technical Field)

The present invention relates to a multiple-position, multiple-use watering apparatus which may be either ground mounted or hand-held in operation.

2. Background Art

Several combined nozzle and sprinkler devices exist in the prior art. Typically, such devices are two-way devices, permitting either nozzle or sprinkler operation, and are attachable to a garden hose or the like. For example, U.S. Pat. No. 523,941, to North, et al., entitled Combined Sprayer and Nozzle, generally discloses a two-way valve-actuated sprinkler and nozzle device. The device may be hand-held or ground mounted by means of a stationary spike. The dangers inherent in such structure are obvious.

Similarly, U.S. Pat. No. 1,031,176, to Gilpin, entitled Combined Nozzle, Sprayer, and Sprinkler, discloses a two-way valve, sprinkler/nozzle combination device wherein valve operation is actuated by manually extending and planting two spikes in the ground.

U.S. Pat. No. 1,026,742, to French, entitled Combination Hose Nozzle and Sprayer, teaches a three-positional valve spraying device which may be actuated to a fully off position, a nozzle only position, and a sprayer only position.

Other combination nozzle/sprayer devices rely upon relatively complex valve structure for operation. U.S. Pat. No. 623.057, to Wentz, entitled Combined Nozzle and Sprayer; and U.S. Pat. No. 1,612,326, to Taylor, entitled Garden Hose Attachment, also rely on rather complex valve structure to actuate their respective spray heads.

SUMMARY OF THE INVENTION

(DISCLOSURE OF THE INVENTION)

The present invention comprises apparatuses for watering having a plurality of waterways and spray heads.

The first apparatus of the invention comprises a casing with a contoured grip, a first flow control for directing water through the casing and out through a first spray head, and a second flow control for directing flow through the casing and out through a second spray head. In the preferred embodiment, the two flow controls comprise waterways which may further comprise valves or inlet conduits for controlling flow in the waterways. The casing further comprises pivotable spikes. One of the spray heads comprises an omnidirectional sprinkler head and one a sectorial sprinkler head.

The second apparatus of the invention comprises a hollow casing with a contoured grip a plurality of waterways within the casing, the waterways comprising diverse spray heads, and inlet conduits for providing liquid flow to the waterways. In the preferred embodiment, the plurality of waterways comprise valves or inlet conduits, each waterway comprising a valve. The hollow casing further comprises pivotable spikes and a hose attachment. One of the diverse spray heads comprises a flared sprinkler head and another an omnidirectional sprinkler head.

The third apparatus of the invention comprises a casing, an inlet conduit providing liquid flow to a plurality of waterways within the casing, and a flow control within the plurality of waterways, wherein one of the waterways comprises an omnidirectional spray head and another a sectorial spray head. In the preferred embodiment, the apparatus further comprises a plurality of inlet conduits and the casing further comprises a contoured grip and pivotable spikes.

Accordingly, an object of the invention is the provision of a relatively simple combination watering apparatus.

A further object of the invention is the provision of a watering apparatus adapted to hand-held or ground mounted operation.

Yet another object of the invention is the provision of a watering apparatus comprising at least four modes of operation.

Still another object of the invention is the provision of a combination watering apparatus requiring no valves.

An advantage of the invention is the provision of diverse spray heads in a unitary watering apparatus.

Yet another advantage of the invention is its simplicity and ease of manufacture.

A further advantage of the invention is its ready adaptability to multiple modes of operation.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENT

(BEST MODE FOR CARRYING OUT THE INVENTION)

Figure 1:
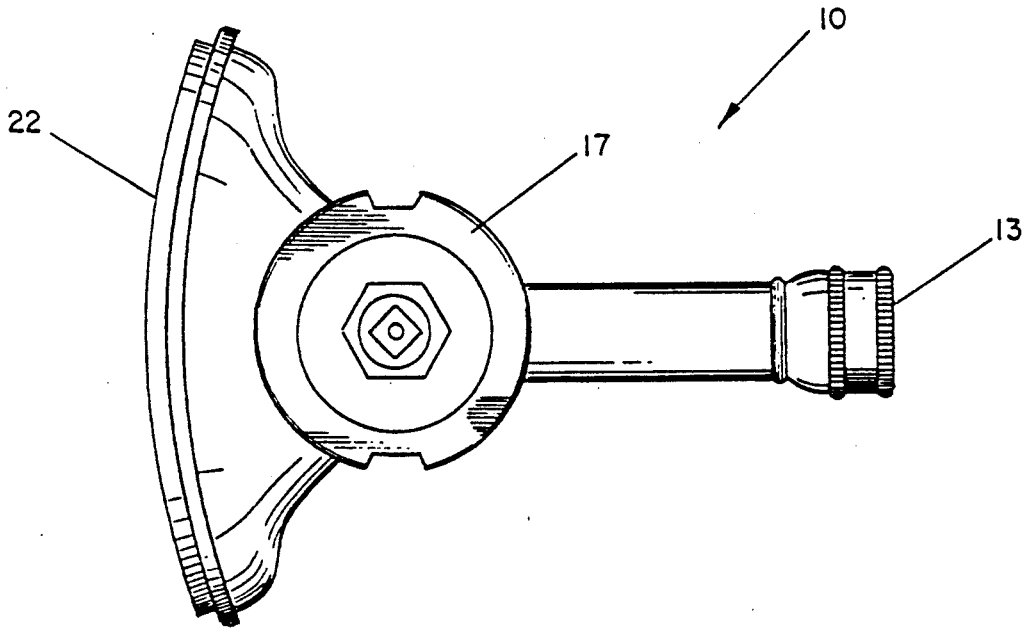
FIG. 1 is a top view of the preferred embodiment of the invention.
Figure 2:
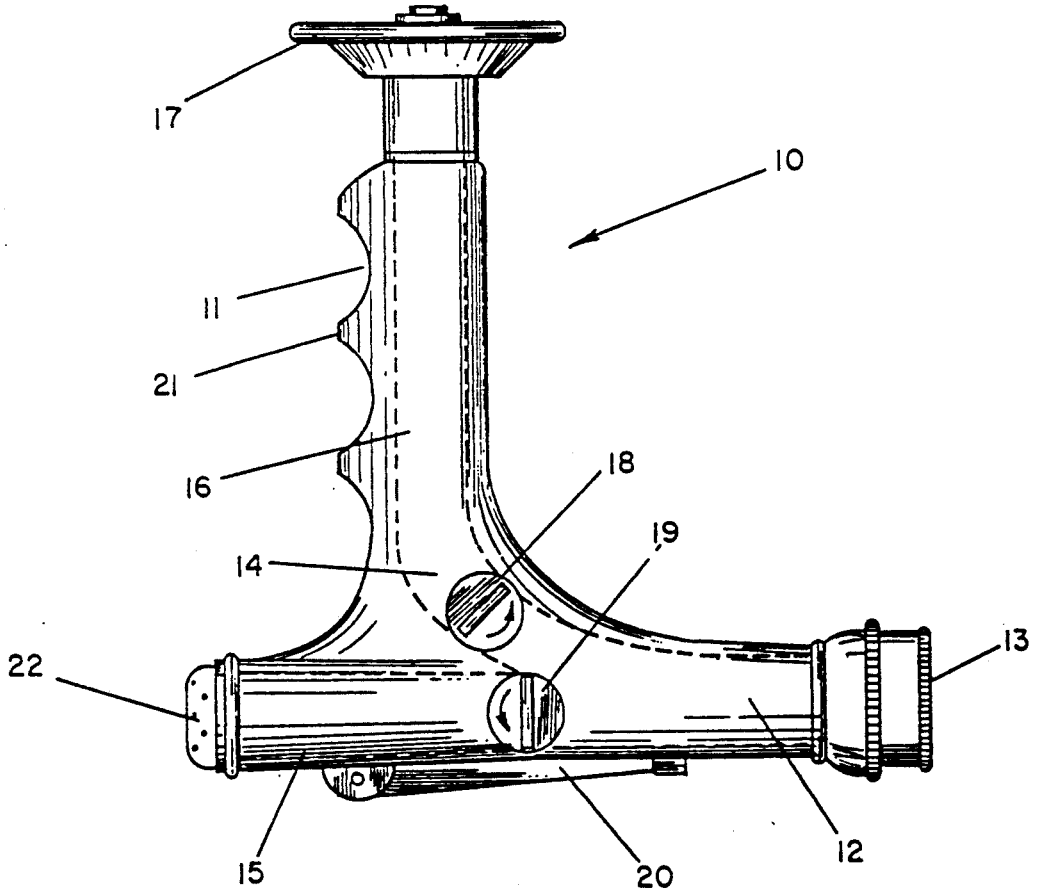
FIG. 2 is a side view of the preferred embodiment of the invention.
Figure 3:
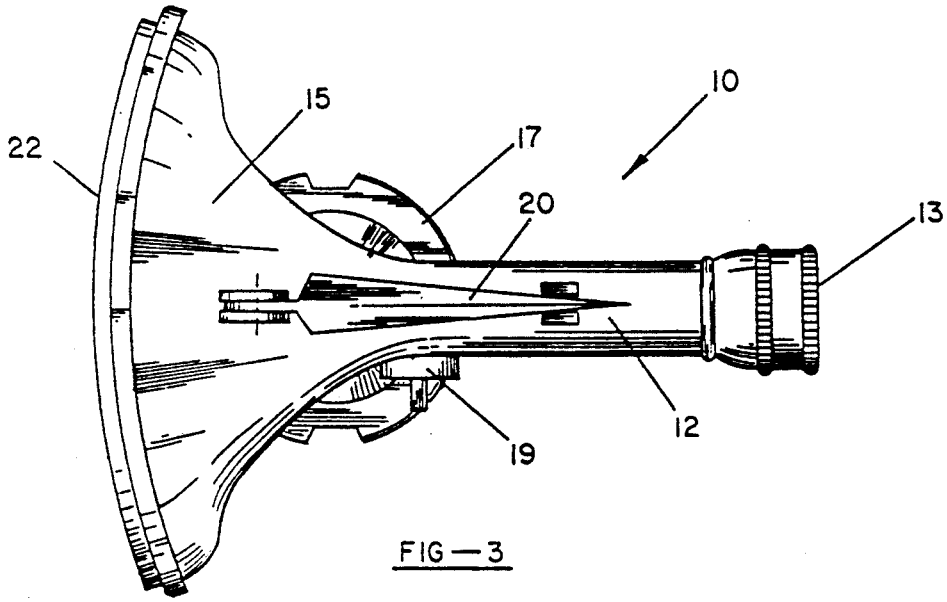
FIG. 3 is a bottom view of the preferred embodiment of the invention.
Figure 4:
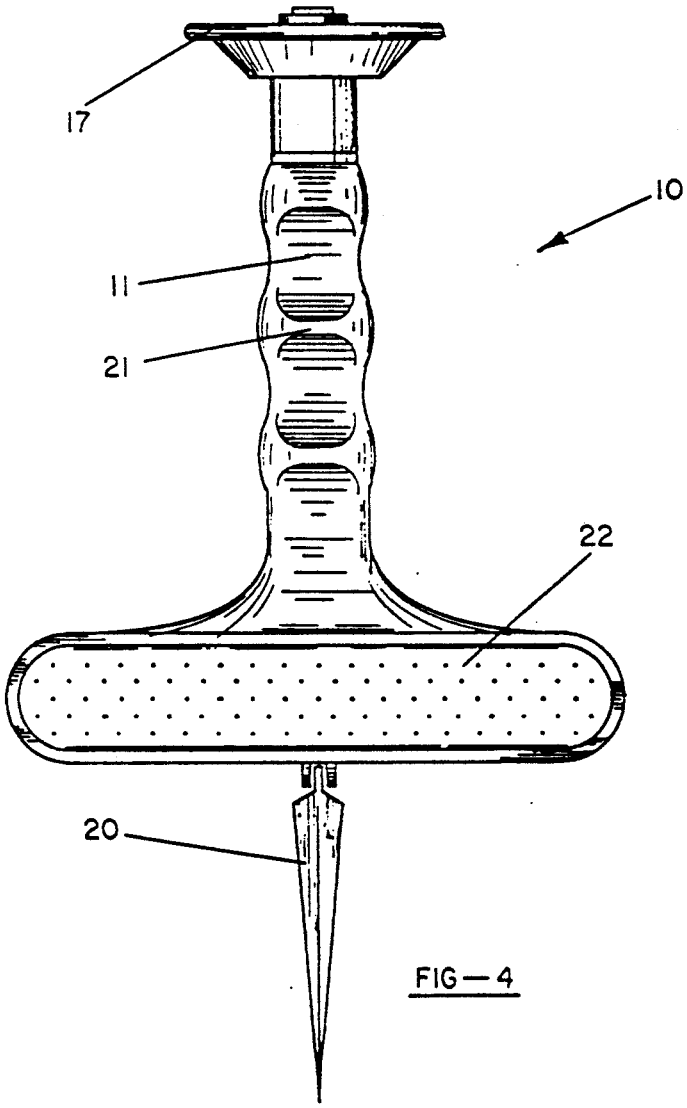
FIG. 4 is a front view of the preferred embodiment of the invention.
Figure 5:
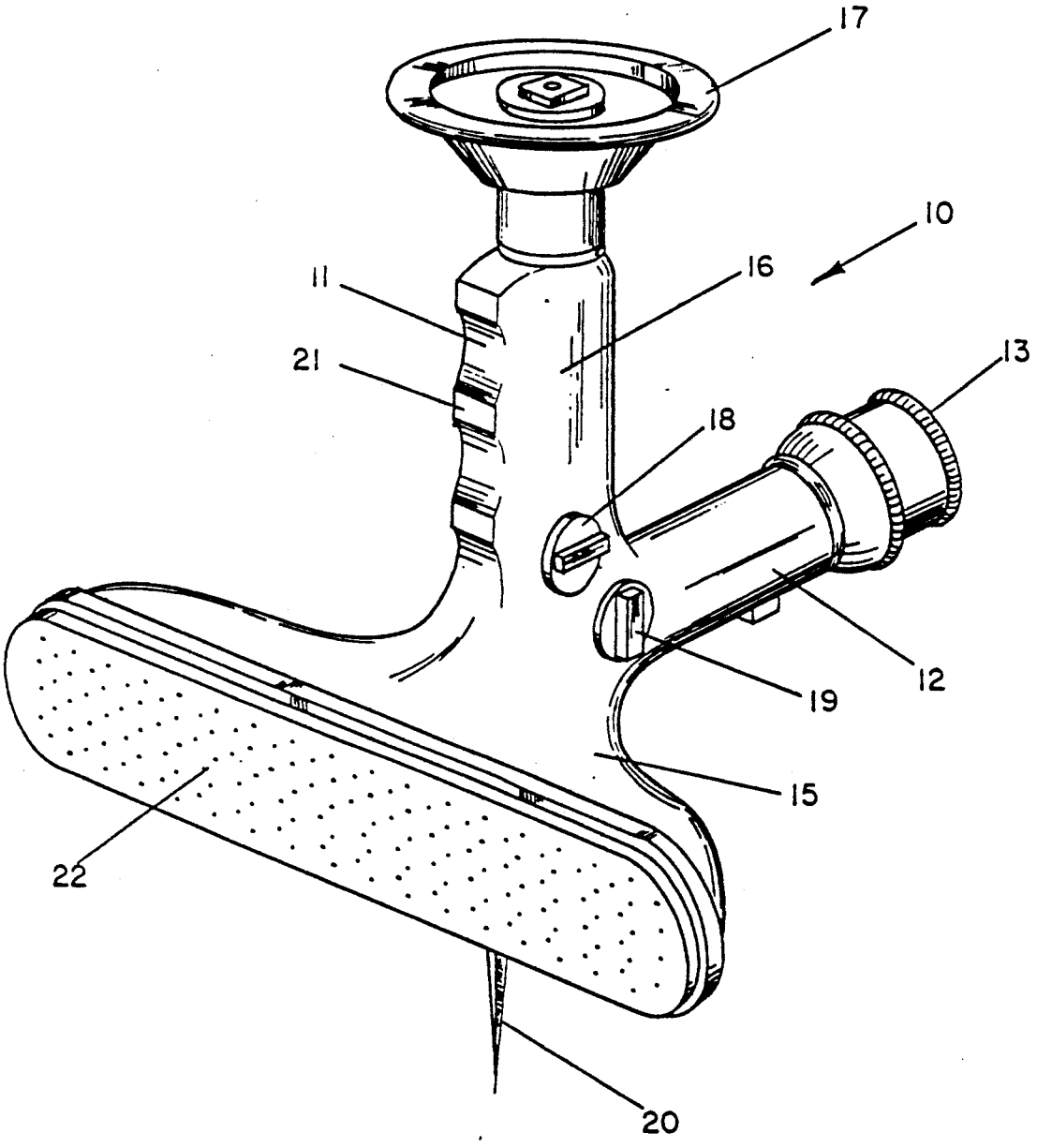
FIG. 5 is a perspective view of the preferred embodiment of the invention.

FIGS. 1-5 depict the preferred embodiment of the invention. Watering apparatus 10 comprises hollow casing 11, typically of plastic or metal construction. Casing 11 further comprises inlet conduit 12, providing initial ingress of water into casing 11. Inlet conduit 12 further comprises threaded hose attachment collar 13 for attachment to the threaded outlet portion of a standard diameter garden hose. Inlet conduit 12 is bifurcated at 14, thereby forming waterway 15 and waterway 16.

Waterway 16 curves at 90° to inlet conduit 12, thereby diverting and directing flow to omnidirectional sprinkler head 17. Interposed between bifurcation 14 and omnidirectional sprinkler head 17 is valve 18.

Valve 18 may comprise a ball valve, butterfly valve, or valves of conical or cylindrical configuration; all of which are well known in the art. Preferably, valve 18 is of simple, reliable construction, fabricated of relatively inexpensive material, such as plastic, or the like. The only requirement for valve 18 is that it be manually manipulatable, externally of casing 11, from fully open to fully closed positions, while regulating volume of flow at intermediate positions.

Waterway 15 extends straightaway from bifurcation 14 along the longitudinal axis of inlet conduit 12 to flared, sectorial, or arcuate sprinkler head 22. Waterway 15 also comprises valve 19, likewise operable from fully open to fully closed positions, while regulating volume of flow at intermediate positions thereof.

Casing 11 further comprises pivotable spike 20 for securely positioning watering device 10 at any desired location on the ground. When the watering device is hand-held in operation, spike 20 is pivoted upwards against casing 11 to provide less hazard to the user.

Casing 11 further comprises contoured hand grip 21 for preventing slippage and providing ease of directional control when using watering apparatus 10 manually. Contoured grip 21 may also comprise checkering or knurls to further ensure a secure grip.

In operation, watering apparatus 10 provides four modes of operation. One mode comprises valve 18 opened with valve 19 closed. This mode provides 360° of water spray coverage by omnidirectional sprinkler head 17 in a circle about apparatus 10. Radial distance of spray is regulated by adjustment of valve 18. Preferably, spike 20 is extended and device 10 is staked to the ground at the desired watering location.

A second mode of operation of the preferred embodiment of the invention comprises operation with valve 19 open while valve 18 is closed. This mode provides spray from flared or arcuate sprinkler head 22. When watering apparatus 10 is hand held, this mode of operation provides a light directional spray having a sectorial envelope.

A third mode of operation of watering apparatus 10 also comprises operation with valve 19 open and valve 18 closed. Instead of being hand-held, however, spike 20 is extended and staked in a desired position to provide sectorial spray coverage by sprinkler head 22. This is accomplished by staking watering apparatus 10 such that sector sprinkler head 22 is at a desired angle of elevation to effect desired sectorial spray coverage of a specific area.

The fourth mode of operation requires both valve 18 and valve 19 to be open. In this operation, spike 20 is normally extended and watering apparatus 10 is staked at a desired location. This operation provides both omnidirectional spray coverage from omnidirectional sprinkler head 17 and sectorial spray coverage from flared sprinkler head 22. As before, flared sprinkler head 22 may be inclined at any desired angle to effect increased water coverage of a specific area.

The advantages provided by the preferred embodiment of the invention are manifold. The preferred embodiment of watering apparatus 10 provides at least four modes of operation. The apparatus is not dependent upon complex valve structure, but instead relies on extremely simple valves controlling a plurality of waterways connected to diverse sprinkler heads. This, in turn, provides distinctly different water sprays.

Figure 6:
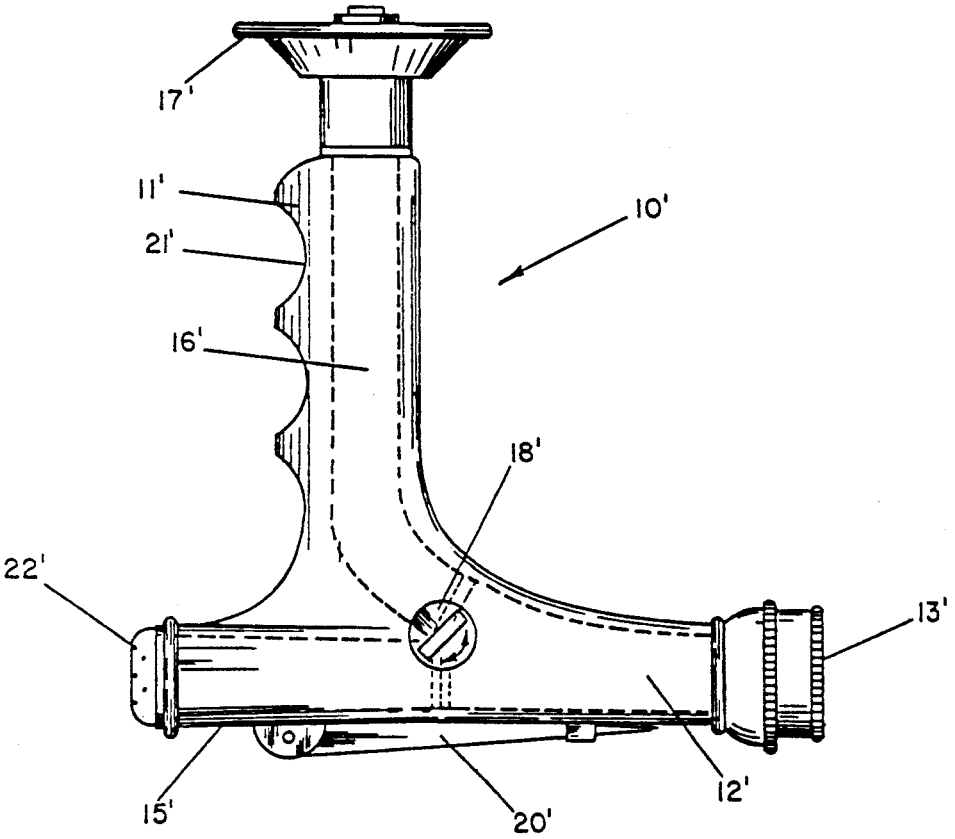
FIG. 6 is a side view of an alternative embodiment of the invention.

FIG. 6 shows an alternative embodiment of the invention. Components identical to the FIGS. 1–5 preferred embodiment of the invention are identically numbered with primes in FIG. 6.

The alternative embodiment of the invention is identical in all respects to the preferred embodiment of the invention with the single exception that the alternative embodiment of the invention comprises single valve 18' for controlling both waterway 15' and waterway 16'. Such flow control is, of course, mutually exclusive: waterway 15' and waterway 16' cannot be used simultaneously.

Nevertheless, alternative embodiment 10' provides three modes of operation: omnidirectional spray head 17' may provide omnidirectional spray capability, while flared spray head 22' can provide either hand-held or staked spray coverage, as previously described with respect to operational modes of the preferred embodiment of the invention.

Figure 7:
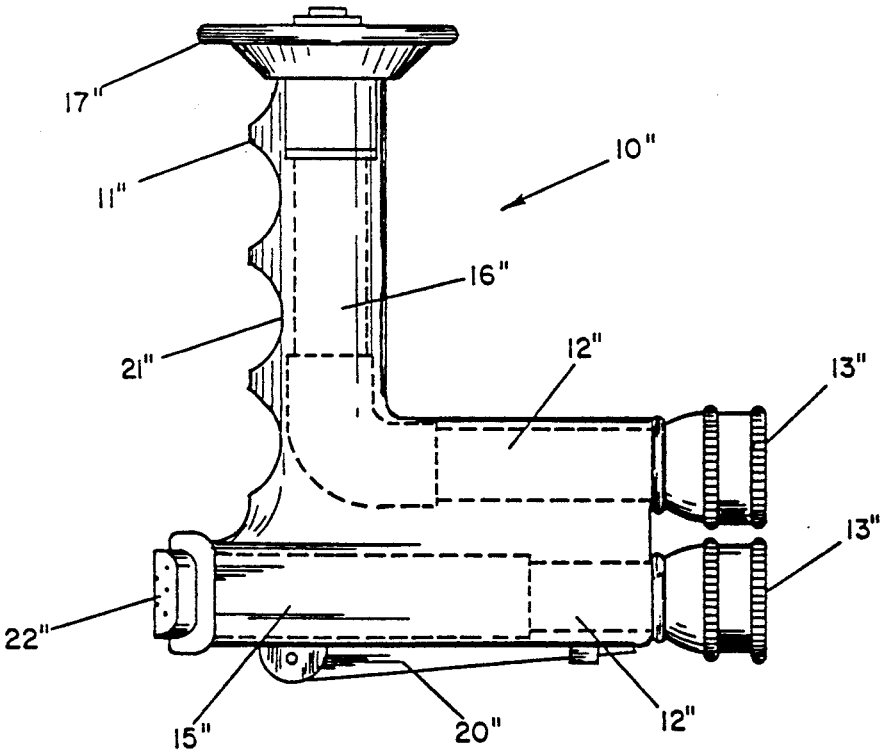
FIG. 7 is a side view of another alternative embodiment of the invention.

A further alternative embodiment of the invention is illustrated in FIG. 7. Again, identical components are labelled by identical numbers double primed.

The second alternative embodiment of FIG. 7 is generally similar to the preferred embodiment and the first alternative embodiment of the invention, but differs in that each waterway 15", 16" within hollow casing 11" comprises separate inlet conduits 12", 12". Each inlet conduit 12", 12" also comprises separate hose attachments 13", 13". Accordingly, this embodiment of the invention lacks valves entirely, but instead employs direct hose attachment to either or both inlet conduits 12", 12" for flow control. Flow volume is directly controlled at the taps, spigots, or faucets to which the hoses are connected.

This embodiment of the invention also provides four modes of use, similar to the preferred embodiment of the invention. Topmost hose connection 13" alone may be connected to a hose, providing 360° water coverage from omnidirectional head 17". Preferably, spike 20" is extended for ground staked operations.

Alternatively, bottommost hose connection 13" may be connected, thereby providing sectorial spray coverage from spray head 22". This connection permits either hand-held or ground operation.

Finally, both hose connections can be connected to hoses, thereby providing both sectorial and omnidirectional coverage from spray heads 22" and 17", respectively.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A watering apparatus for both hand-held and ground use comprising:

casing means comprising contoured hand grip means disposed about first waterway means for directing water flow through said casing means in a first relatively vertical direction through a first spray head means;

second waterway means for directing water flow through said casing means in a second relatively horizontal direction through a second spray head means;

means for controlling flow in said first and second waterway means, wherein said means for controlling flow in said first and second waterway comprises valve means enabling simultaneous or independent flow in both said first and second waterway means; and ground engaging means comprising pivotable spike means wherein said watering apparatus is capable of four modes of operation.

2. The invention of claim 1 wherein said first spray head means comprises omnidirectional sprinkler head means.

3. The invention of claim 1 wherein said second spray head means comprises sectorial sprinkler head means.

4. A watering apparatus for both hand-held and ground use comprising:

hollow casing means comprising contoured hand grip means;

a plurality of waterway means, each provided with valve means within said hollow casing means;

one of said plurality of waterway means comprising a relatively vertically disposed omnidirectional sprinkler head means;

another of said plurality of waterway means comprising a relatively horizontally disposed flared sprinkler head means;

inlet conduit means for providing liquid flow to said plurality of waterway means;

wherein said contoured grip means is disposed about said one of said plurality of waterway means comprising said relatively vertically disposed omnidirectional sprinkler head means; and ground engaging means comprising pivotable spike means, wherein said watering apparatus is capable of four modes of operation.

5. The invention of claim 4 wherein said hollow casing means further comprises hose attachment means.

6. A watering apparatus comprising:

casing means comprising contoured hand grip means and pivotable spike means;

inlet conduit means providing liquid flow to a plurality of waterway means within said casing means;

wherein one of said plurality of waterway means comprises a relatively vertically disposed waterway with said contoured hand grip and an omnidirectional spray head means disposed thereon;

another of said plurality of waterway means comprises a relatively horizontally disposed waterway with a sectorial spray head means disposed thereon; and wherein said inlet conduit means comprises a plurality of inlet conduit means, each providing liquid flow to a single waterway.

* * * * *

UNITED STATES PATENT AND TRADEMARK OFFICE

CERTIFICATE OF CORRECTION

PATENT NO. : 5,160,093

DATED : November 3, 1992

INVENTOR(S) : John J. Battaglia

It is certified that error appears in the above-identified patent and that said Letters Patent is hereby corrected as shown below:

On title page, item [76] should read as follows;

Inventor: John J. Battaglia,
5202 Valle Vista, N.W.
Albuquerque, New Mexico 87120

Signed and Sealed this

Sixteenth Day of November, 1993

Bruce Lehman

*Attest:*

BRUCE LEHMAN

*Attesting Officer*

*Commissioner of Patents and Trademarks*